US008245426B2

(12) United States Patent
Pikielny

(10) Patent No.: US 8,245,426 B2
(45) **Date of Patent: *Aug. 21, 2012**

(54) FIREARM WITH LOADED / UN-LOADED IDENTIFICATION SYSTEM

(76) Inventor: Dov Pikielny, Herzliya (IL)

( * ) Notice: Subject to any disclaimer, the term of this patent is extended or adjusted under 35 U.S.C. 154(b) by 0 days.

This patent is subject to a terminal disclaimer.

(21) Appl. No.: 12/705,991

(22) Filed: Feb. 16, 2010

(65) Prior Publication Data

US 2010/0139142 A1 Jun. 10, 2010

Related U.S. Application Data

(63) Continuation-in-part of application No. 11/672,073, filed on Feb. 7, 2007, now Pat. No. 7,661,218.

(51) Int. Cl.
*F41A 9/53* (2006.01)

(52) U.S. Cl. ..... 42/1.05; 42/70.1

(58) Field of Classification Search ..... 42/70.01, 42/1.01, 1.05

See application file for complete search history.

(56) References Cited

U.S. PATENT DOCUMENTS 4,541,191 A * 9/1985 Morris et al. ..... 42/1.01
4,793,085 A * 12/1988 Surawski et al. ..... 42/84
4,934,086 A * 6/1990 Houde-Walter ..... 42/115
5,005,307 A * 4/1991 Horne et al. ..... 42/1.02
5,016,378 A * 5/1991 Sain ..... 42/70.06
5,052,138 A * 10/1991 Crain ..... 42/1.02
5,142,805 A * 9/1992 Horne et al. ..... 42/1.02
5,303,495 A * 4/1994 Harthcock ..... 42/84
5,531,040 A * 7/1996 Moore ..... 42/115
5,694,713 A * 12/1997 Paldino ..... 42/115
5,896,691 A * 4/1999 Kaminski et al. ..... 42/70.11
6,094,850 A * 8/2000 Villani ..... 42/1.02
7,661,217 B2 * 2/2010 Pikielny ..... 42/1.01
2006/0026886 A1 * 2/2006 Doukas ..... 42/117
2007/0186457 A1 * 8/2007 Pitt ..... 42/70.06
2008/0110075 A1 * 5/2008 Pikielny ..... 42/70.01
2010/0139141 A1 * 6/2010 Pikielny ..... 42/1.03

* cited by examiner

*Primary Examiner* — Michael Carone
*Assistant Examiner* — Samir Abdosh
(74) *Attorney, Agent, or Firm* — Dekel Patent Ltd.; David Klein

(57) ABSTRACT

An article including an article including a firearm including a safety that moves between a safe position that does not permit firing of the firearm and a fire position that permits firing of the firearm, the firearm further including a light indicator, and a loaded chamber indicator in electrical communication with the light indicator, wherein when the safety moves to the fire position, the light indicator emits a first distinct color if a round is loaded in a chamber of the firearm, and the light indicator emits a second distinct color if a round is not loaded in the chamber of the firearm.

1 Claim, 3 Drawing Sheets

FIREARM WITH LOADED / UN-LOADED IDENTIFICATION SYSTEM

CROSS-REFERENCE TO RELATED APPLICATIONS

This application is a continuation-in-part of, and claims priority under 35 USC §120 from, U.S. patent application Ser. No. 11/672,073, filed Feb. 7, 2007, now U.S. Pat. No. 7,661,218, which is incorporated herein by reference.

FIELD OF THE INVENTION

The present invention relates generally to firearms, and particularly to firearms wherein the safety doubles as an on-off switch for electrical accessories.

BACKGROUND OF THE INVENTION

U.S. Pat. No. 4,934,086 to Houde-Walter describes a recoil spring guide mounting for a laser sight. A laser sight for a firearm has a recoil spring guide. Components are mounted on the spring guide so that a light beam is directed along the axis of the spring guide. This automatically makes the light beam parallel with the barrel of the firearm.

U.S. Pat. No. 5,509,226 to Houde-Walter describes a laser sight having a power source disposed substantially entirely within the recoil spring guide chamber of a firearm, such as the recoil cavity of a pistol. The laser sight is itself contained in an elongated housing having at one end a window through which a laser beam is emitted and at the other end a battery cap.

U.S. Pat. No. 5,179,235 to Toole describes a laser sighting device for a pistol includes a universally mounted laser diode at the forward end of the pistol's trigger guard, wherein positioning of the laser beam is accomplished via adjustment screws from within the trigger guard. An energizing cable in the pistol structure is connected to a power supply located within the pistol's handgrip, and an externally operable activating switch is provided at the rear of the handgrip which is easily actuated by the user's hand immediately before the trigger is operated. The switch means is operable by pressure from the hand of the user between thumb and forefinger as the user's forefinger is inserted through the trigger guard.

SUMMARY OF THE INVENTION

The present invention seeks to provide a firearm wherein the safety doubles as an on-off switch for electrical accessories, as is described more in detail hereinbelow. Specifically, the invention provides the firearm with a loaded/un-loaded identification system.

There is thus provided in accordance with an embodiment of the present invention an article including an article including a firearm including a safety that moves between a safe position that does not permit firing of the firearm and a fire position that permits firing of the firearm, the firearm further including a light indicator, and a loaded chamber indicator in electrical communication with the light indicator, wherein when the safety moves to the fire position, the light indicator emits a first distinct color if a round is loaded in a chamber of the firearm, and the light indicator emits a second distinct color if a round is not loaded in the chamber of the firearm.

The firearm may further include a striker status indicator, which indicates if the firearm is un-cocked or cocked, in electrical communication with the light indicator, wherein when the safety moves to the fire position, the light indicator emits a third distinct color if the firearm is un-cocked, and the light indicator emits a fourth distinct color if the firearm is cocked.

There is also provided in accordance with an embodiment of the present invention an article including a firearm including a loaded/un-loaded identification system that includes a loaded chamber indicator and a striker status indicator, wherein when the loaded chamber indicator protrudes out the firearm is loaded and when the loaded chamber indicator does not protrude out the firearm is not loaded, and when the striker status indicator protrudes out the firearm is cocked and when the striker status indicator does not protrude out the firearm is not cocked, and at least one switch that operates with the loaded chamber indicator and the striker status indicator and with a set of differently colored lights, wherein when a first colored light is illuminated, the firearm is un-cocked and unloaded, when a second colored light is illuminated, the firearm is loaded and un-cocked, when a third colored light is illuminated, the firearm is cocked and unloaded, and when a fourth colored light is illuminated, the firearm is loaded and cocked.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
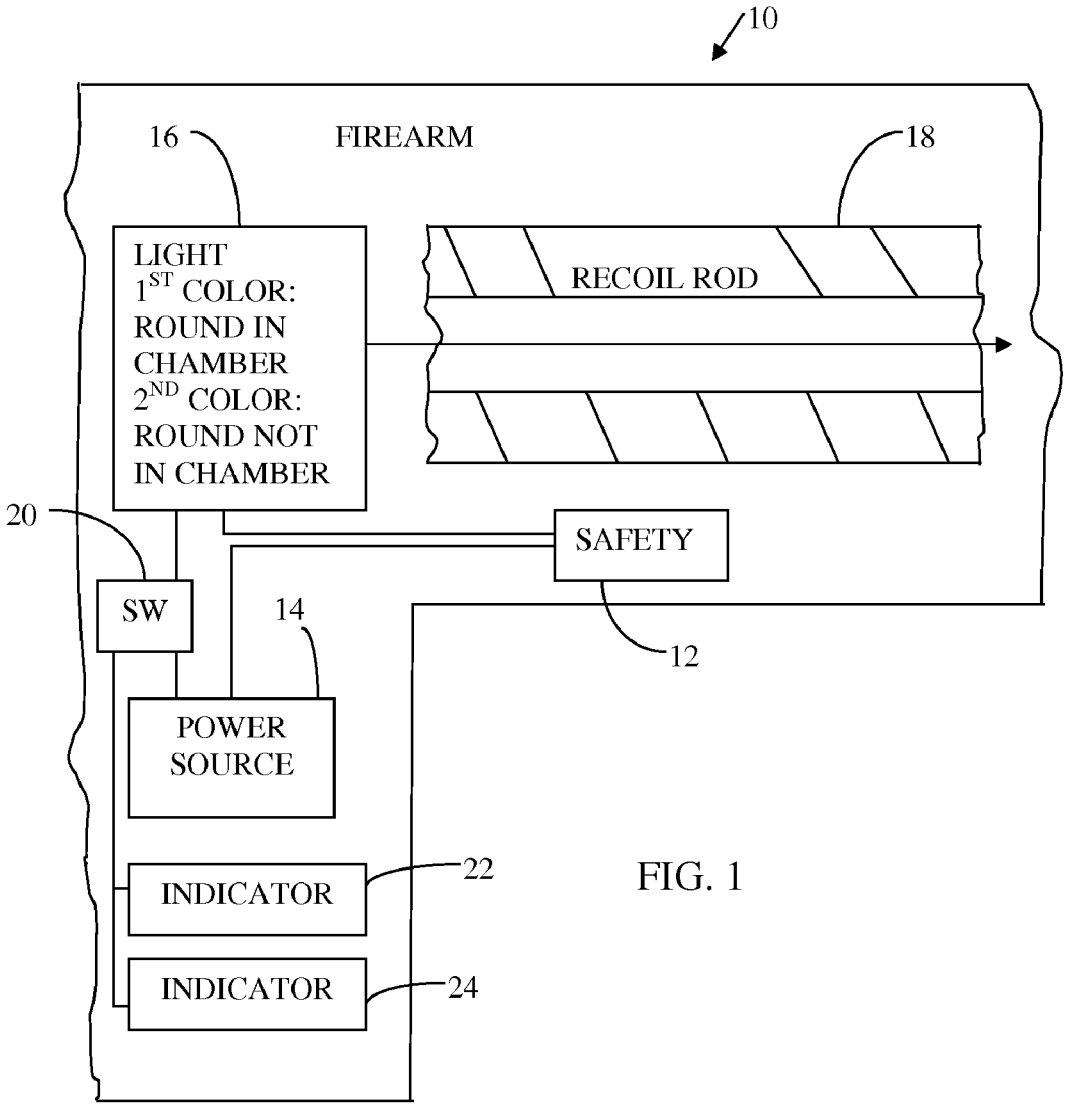
FIG. 1 is a simplified illustration of a firearm with a loaded/un-loaded identification system, constructed and operative in accordance with an embodiment of the present invention.

Reference is now made to FIG. 1, which illustrates a firearm 10 with an on/off safety switch 12, constructed and operative in accordance with an embodiment of the present invention. A power source 14 (such as a battery) powers a light indicator 16 (such as a laser light), also referred to as light 16. The safety switch 14, which may be a trigger safety, for example, is connected to power source 14 and light 16. The light 16 may be arranged to illuminate through a recoil rod 18.

In one non-limiting embodiment of the invention, light 16 is an internal laser device whose modules are integrated as internal module in the firearm (not like LASER MAX® or CRIMSON TRACE®, which are external modules). The laser beam may pass through the recoil rod 18, which means that the entire recoil rod 18 is hollow, but is not a part of the recoil rod like LASER MAX® LMS-4XD40 internal laser sight. In other words, the rod 18 is like a tunnel for the laser beam to travel through. A rheostat or other control device (not shown) may be provided that allows making the sight brighter or dimmer for day/night vision/or bright direct sun, etc. (controls brightness of the internal laser device).

Figure 3A:
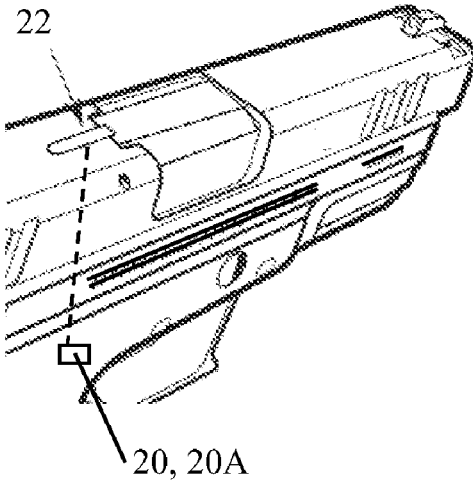
FIGS. 3A and 3B are simplified illustrations of a loaded chamber indicator in respective in (or down, indicating no round in the chamber) and out (or up, indicating a round in the chamber) positions, in accordance with an embodiment of the present invention.
Figure 3B:
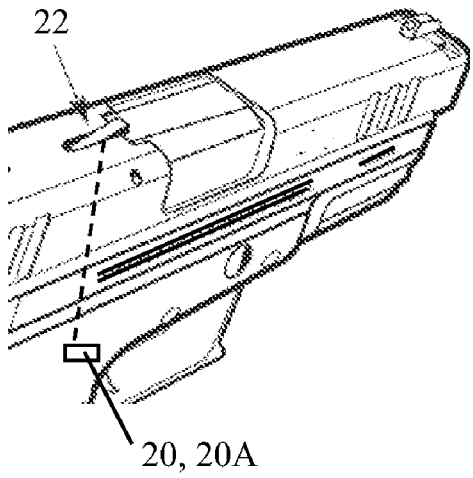

Light 16 may be an assembly of two lights, e.g., two colored lasers; one red, when the gun is loaded with live ammunition, and one green for training purposes. The selection between the red and green laser may be made with safety switch 14, or alternatively with another switch 20, in electrical communication with (or integrated with) a "round in the chamber indicator", referred to as a loaded chamber indicator 22, an example of which is shown in FIGS. 3A and 3B. The loaded chamber indicator 22 in FIGS. 3A and 3B is based on the loaded chamber indicator in Springfield Armory XD models. When the indicator 22 is up (i.e., the round is loaded in the chamber), switch 14 or 20 switches on the red laser; when the indicator 22 is down (no round in chamber) the green laser works.

Another example of switch 20 is a "loaded"/"unloaded" sight indicator, which may include a fiber optic rear sight, which can switch the lights from red to green and vice versa in order to indicate/provide feedback to the shooter whether the gun is loaded or is not.

The following is a non-limiting example of operation of the firearm with the safety. It is appreciated that the features mentioned in this example may also be used with other passive or active safeties.

i. Once the gun is cocked and a round is loaded in the chamber, switch 14 or 20 cooperating with loaded chamber indicator 22 may turn on a red laser mounted on or in any suitable portion of the firearm. A laser beam will be emitted by the laser once the trigger safety is squeezed and before the trigger itself is squeezed. There is no need to move the trigger itself in order to emit the laser beam.

ii. Once the trigger safety is squeezed and a round is loaded in the chamber, a sight (mounted on or in any suitable portion of the firearm) turns red. If there is no ammunition in the chamber, the sights turn green. The sight may be a fiber optic sight.

iii. Once the gun is fired, in case another round is not chambered immediately thereafter, the laser is switched to green while the round in the chamber indicator drops down.

Figure 2:
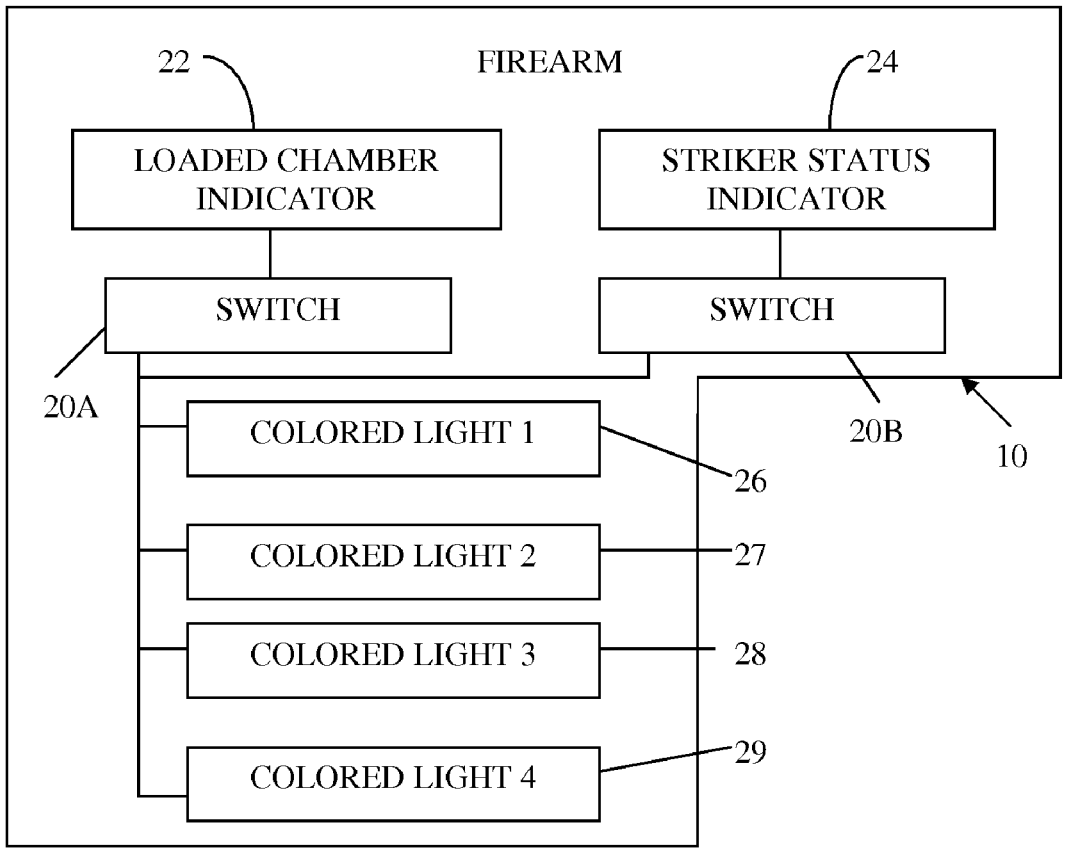
FIG. 2 is a simplified illustration of a firearm with a loaded/un-loaded identification system, constructed and operative in accordance with another embodiment of the present invention.

Reference is mow made to FIG. 2, which illustrates firearm 10 with a loaded/unloaded identification system, constructed and operative in accordance with another embodiment of the present invention.

Figure 4A:
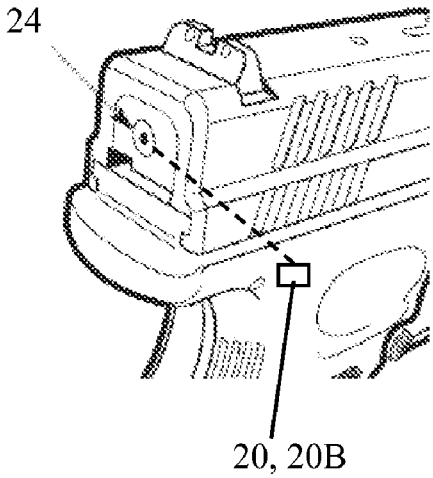
FIGS. 4A and 4B are simplified illustrations of a striker status indicator in respective in (indicating the firearm is un-cocked) and out (indicating the firearm is cocked) positions, in accordance with an embodiment of the present invention.
Figure 4B:
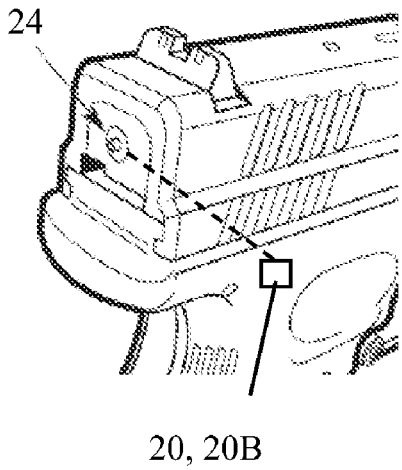

This embodiment not only employs the loaded chamber indicator 22, but also a striker status indicator 24, an example of which is shown in FIGS. 4A and 4B. The striker status indicator 24 in FIGS. 4A and 4B is based on the striker status indicator in Springfield Armory XD models. When the indicator 24 is in the firearm is not cocked; when the indicator 24 is out the firearm is cocked. Switch 20A operates with loaded chamber indicator 22, and switch 20B operates with striker status indicator 24. Here again, the safety switch 14 may be electrically connected to indicators 22 and 24 and serve the purpose of switches 20A and 20B.

When the firearm is empty the loaded chamber indicator 22 is down, and the switch 20A is in a first position. When the firearm has a round in the chamber (but not necessarily cocked) the loaded chamber indicator 22 is up, thereby throwing switch 20A to a second position. When the firearm is un-cocked the striker status indicator 24 is in, and the switch 20B is in a first position. When the firearm is cocked, the striker status indicator 24 protrudes out, thereby throwing switch 20B to a second position.

It is noted that there are situations when a person is "playing" with the firearm and cocking it without a live round. In such a situation the striker status indicator 24 will protrude out but the firearm is not loaded. There are situations in which there is a round in the chamber which could be manually inserted; the firearm is loaded but not ready to shoot as it is not cocked. Only the combination of the loaded chamber indicator 22 being up and the striker status indicator 24 being out means the firearm is loaded and cocked and ready for shooting.

Switches 20A and 20B cooperate with different colored lights (such as lights 26, 27, 28 and 29) to provide the following indications.

1. Colored light 1 (e.g., green) alone is illuminated: The firearm is un-cocked and unloaded—safe.

2. Colored light 2 (e.g., orange) alone is illuminated: The firearm is loaded and un-cocked.

3. Colored light 3 (e.g., purple) alone is illuminated: The firearm is cocked and unloaded.

4. Colored light 4 (e.g., red) alone is illuminated: The firearm is loaded and cocked (ready for shooting).

It will be appreciated by persons skilled in the art that the present invention is not limited to what has been particularly shown and described hereinabove. Rather, the scope of the present invention includes both combinations and subcombinations of the various features described hereinabove, as well as variations and modifications thereof that are not in the prior art, which would occur to persons skilled in the art upon reading the foregoing description.

What is claimed is:

1. An article comprising:

a firearm comprising a loaded/un-loaded identification system that comprises a loaded chamber indicator and a striker status indicator, wherein when said loaded chamber indicator protrudes out said firearm is loaded and when said loaded chamber indicator does not protrude out said firearm is not loaded, and when said striker status indicator protrudes out said firearm is cocked and when said striker status indicator does not protrude out said firearm is not cocked; and at least one switch that operates with said loaded chamber indicator and said striker status indicator and with a set of differently colored lights, wherein:

when a first colored light is illuminated, said firearm is un-cocked and unloaded;

when a second colored light is illuminated, said firearm is loaded and un-cocked;

when a third colored light is illuminated, said firearm is cocked and unloaded; and when a fourth colored light is illuminated, said firearm is loaded and cocked.

* * * * *